US005231424A

United States Patent [19]

Kaneko et al.

[11] Patent Number: 5,231,424

[45] Date of Patent: Jul. 27, 1993

[54] INK JET RECORDING APPARATUS WITH EFFICIENT CIRCULATION RECOVERY

[75] Inventors: Mineo Kaneko, Tokyo; Hidemi Kubota, Komae; Yutaka Koizumi, Tokyo; Torachika Osada, Kawasaki; Toshiaki Hirosawa, Hiratsuka; Jiro Moriyama, Yokohama, all of Japan

[73] Assignee: Canon Kabushiki Kaisha, Tokyo, Japan

[21] Appl. No.: 659,697

[22] Filed: Feb. 25, 1991

[30] Foreign Application Priority Data

Feb. 26, 1990 [JP] Japan ..... 2-044977
Feb. 26, 1990 [JP] Japan ..... 2-044979

[51] Int. Cl.[5] ..... B41J 2/175; B41J 2/165
[52] U.S. Cl. ..... 346/140 R
[58] Field of Search ..... 346/1.1, 75, 140 R

[56] References Cited

U.S. PATENT DOCUMENTS

| | | | |
|---|---|---|---|
| 4,007,465 | 2/1977 | Chaudhary | 346/140 R |
| 4,313,124 | 1/1982 | Hara | 346/140 R |
| 4,345,262 | 8/1982 | Shirato et al. | 346/140 R |
| 4,380,770 | 4/1983 | Maruyama | 346/140 R |
| 4,459,600 | 7/1984 | Sato et al. | 346/140 R |
| 4,463,359 | 7/1984 | Ayata et al. | 346/1.1 |
| 4,543,589 | 9/1985 | Terasawa | 346/140 R |
| 4,558,333 | 12/1985 | Sugitani et al. | 346/140 R |
| 4,723,129 | 2/1988 | Endo et al. | 346/1.1 |
| 4,740,796 | 4/1988 | Endo et al. | 346/1.1 |
| 4,947,191 | 8/1990 | Nozawa et al. | 346/140 R |
| 4,999,643 | 3/1991 | Terasawa | 346/1.1 |
| 5,008,688 | 4/1991 | Ebinuma et al. | 346/140 R |

FOREIGN PATENT DOCUMENTS

| | | |
|---|---|---|
| 2648079 | 5/1977 | Fed. Rep. of Germany . |
| 3726671 | 7/1988 | Fed. Rep. of Germany . |
| 54-056847 | 5/1979 | Japan . |
| 59-123670 | 7/1984 | Japan . |
| 59-138461 | 8/1984 | Japan . |
| 2112715 | 7/1983 | United Kingdom . |
| 2184066 | 6/1987 | United Kingdom . |

*Primary Examiner*—Benjamin R. Fuller
*Assistant Examiner*—Alrick Bobb
*Attorney, Agent, or Firm*—Fitzpatrick, Cella, Harper & Scinto

[57] ABSTRACT

An ink jet recording apparatus which records by discharging ink onto a recording medium comprises recording head for recording on the recording medium by discharging ink through discharge ports; an ink tank for storing the ink; a first ink flow channel for passing the ink from the ink tank to the recording head; a second ink flow channel for passing the ink from the recording head into the ink tank; a filter provided in the first ink flow channel; and a back flow prevention valve provided in the second ink flow channel.

23 Claims, 13 Drawing Sheets

INK JET RECORDING APPARATUS WITH EFFICIENT CIRCULATION RECOVERY

BACKGROUND OF THE INVENTION

1. Field of the Invention

The present invention relates to an ink jet recording apparatus and recovery method for a recording head, in which the recording is performed by discharging the ink onto a recording medium.

2. Related Background Art

A recording apparatus for printer, copying machine and facsimile terminal equipment is constituted to record images constructed of dot patterns onto a recording medium such as paper or plastic sheet, based on the image information.

The recording apparatus as above mentioned can be classified into the printing methods of ink jet, wire dot-matrix, thermal, and laser beam. Among them, the ink jet printing (ink jet recording apparatus) is constituted to discharge fine droplets or mists of recording liquid (ink) through discharge ports of an ink jet recording head, and to deposit them onto recording medium.

This ink jet recording apparatus has many advantages, for example, high-speed printing, and easy full-colored printing.

To exhibit this advantage sufficiently for a long term, a recovery operation can be performed to prevent or resolve clogging of discharge ports beforehand, or remove impurities such as dirt that enters into the head. A conventional recovery operation will be described below.

FIG. 1 is a typical view showing an example of the ink supply system in the recovery operation for a recording head of conventional ink jet recording apparatus.

In FIG. 1, a storage tank 6 for storing ink and a common liquid chamber 2 for the recording head are connected via a first flow channel 11 and a second flow channel 12. A recovery pump 9 for circulating the ink is connected to one of the flow channels (first channel 1 in the example as shown in the figure), in order to exhaust bubbles in each flow channel or thickened ink in discharge ports (liquid channels).

The flow channels 11, 12 are provided with filters 16, 16, respectively, to capture contaminants. Note that the filters 16, 16 are more effective if they are located closer to a discharge section (for example, liquid channels leading to discharge ports), and in the example as shown in the figure, they are provided at the junctions with each of the flow channels 11, 12 in the common liquid chamber 2.

As described above, a method in which the ink is supplied from one end portion of the common liquid chamber 2 by the recovery pump 9, and circulated from the other end portion of the common liquid chamber 2 into the storage tank 6 is effective to remove bubbles in the flow channels 11, 12 and within the common liquid chamber 2, and more effective particularly when the full-line recording head having a number of discharge ports 3 is used.

In such ink supply system, as the flow channel resistance in the recovery pump 9 is large during the recording operation, the ink flows from the storage tank 6 through the second flow channel 12 into the recording head 1.

FIG. 2 is a typical view showing another example of the ink supply system in a conventional ink jet recording apparatus.

In this example, a recording tank 5 is provided as another storage tank, in addition to a main tank 6, in which if the ink within the recording tank 5 falls below a predetermined quantity, the ink is refilled from the storage tank 6 by a recovery pump 9.

Other ink flows are the same as those in the previously-mentioned ink supply system (FIG. 1), except that in this example, a solenoid valve 7 is provided in a second flow channel, and the ink in a first flow channel 11 and within the common liquid chamber 2 can be exhausted through discharge ports without being returned to the storage tank (recording tank), by activating the recovery pump 9 with the solenoid valve 7 closed. And in this example, filters 14, 14 are provided midway of the first and second flow channels.

Further, a straightening valve 8 for refilling and a straightening valve 10 for recovery are connected at the positions as indicated of the first flow channel 11.

Note that numeral 4 indicates a discharge port face where the discharge ports 3 of the recording head 1 are arranged, and numeral 13 indicates an air vent valve for the storage tank (recording tank).

In a conventional ink supply system as above described, the ink flows through the first flow channel 11 to the recording head 1 during the recovery operation, while it flows through the second flow channel 12 to the recording head 1 during the recording operation, and thus filters 16, 16 or 14, 14 are needed in both flow channels.

However, there is a possibility that discharge failure may occur due to clogging in the liquid channels leading to the discharge ports 3, because fine contaminants passing through the above-mentioned filter have got entagled within the common liquid chamber 2 and may amass and not pass through the filter, or materials peeled off from the interior of the common liquid chamber or contaminants enclosed into the common liquid chamber 2 at the manufacturing process, are caught between two filter plates and can not move from the vicinity of the common liquid chamber 2.

If the discharge ports 3 are more densified, the mesh of the above-mentioned filter must be made more finely, in which the area of filter is required to be larger to prevent the loss of pressure. Specifically, in the first constitutional example (FIG. 1), there was a problem that the recording head containing the above-mentioned filters must be constructed more largely.

Further, FIG. 3 is a typical view showing another example of the ink supply system to a recording head of a conventional ink jet recording apparatus.

In FIG. 3, a recording head (ink jet recording head) 101 is provided with an ink liquid chamber 114 capable of storing ink, and discharge ports 110 for discharging the ink flowing in from the ink liquid chamber, wherein the discharge ports 110 and the ink liquid chamber 114 are communicated via liquid channels where discharge energy generating elements (electricity-heat converters such as heat generating elements) are disposed.

A main tank 102 for storing ink and the ink liquid chamber 114 in the recording head 101 are connected via a first ink flow channel 116A and a second ink flow channel 116B. And a recovery pump 103 is connected to one of the flow channels (first flow channel 116A in the example as shown) in order to exhaust bubbles within the recording head 101 or in the flow channels 116A, 116B, or thickened ink within discharge ports (liquid channels) by feeding ink into the recording head 101.

The flow channels 116A, 116B are provided with filters 117, 117, respectively, to capture contaminants.

As above described, a method in which the ink is supplied from one end portion of the ink liquid chamber 114 by the recovery pump 103, and circulated from the other end portion of the ink liquid chamber 114 into the main tank 102 is effective to remove bubbles in the ink channels 116A, 116B and within the ink liquid chamber 114, and more effective particularly when the full-line recording head having a number of discharge ports 3 is used.

In such ink supply system, as the liquid channel resistance in the recovery pump 103 is large during the recording operation, the ink flows from the main tank 102 through the second flow channel 116B into the recording head 101.

When the ink is circulated into the ink liquid chamber 114 by activating the above-mentioned recovery pump 103, the recovery function of the liquid channels or discharge ports 110 is effected by exhausting a partial quantity of ink from discharge ports 110 and removing cloggings produced therein together with bubbles as previously described.

Thus a cap 104 for receiving ink from discharge ports 110 is provided on the side opposed to the recording head 101, and in which it faces the recording head 101.

The ink exhausted into the cap 104 is passed through a waste ink flow channel 105 into a waste ink tank 106.

FIG. 4 is a typical view showing still another example of the ink supply system in a conventional ink jet recording apparatus.

In this constitutional example, a recording liquid supply tank 120 is provided in addition to a main tank 102, in which if the ink within the recording liquid supply tank 120 falls below a predetermined quantity, the ink is refilled from the main tank 102 through a straightening valve 123 for refilling by a recovery pump 103.

Other ink flows are the same as those in the previously-mentioned ink supply system (FIG. 3), except that in this constitutional example, a straightening valve 122 for recovery is provided in a first ink flow channel 116A, and a solenoid valve 119 is provided in a second ink flow channel 116B.

The ink supply system as shown in FIG. 4 is similar to that shown in FIG. 3 in the above-mentioned constitution, but other portions are constituted substantially in the same way.

In this constitutional example, the ink in the first ink flow channel 116A and within the ink liquid chamber 114 can be exhausted through discharge ports 110 without being returned to the recording liquid supply tank 120, by activating the recovery pump 103 with the solenoid valve 119 closed.

As in FIG. 3, a cap 104 for receiving ink exhausted from discharge ports 110 is provided on the side opposed to the recording head 101, and in which it faces the recording head 101 as shown.

The ink exhausted into the cap 104 is passed through a waste ink flow channel 105 into a waste ink tank 106. Note that numeral 121 indicates an air vent valve for the recording liquid supply tank 20.

FIG. 5 is a typical cross-sectional view showing the details for a portion of the recording head 101 and the cap 104 in the conventional ink supply system as shown in FIGS. 3 and 4.

The recording head 101 comprises an ink liquid chamber 114, a plurality of liquid channels 112 communicating to the ink liquid chamber 114, a plurality of discharge ports 110 formed at tip openings of liquid channels, and electricity-heat converters such as heat generating elements each of which is disposed in each of the liquid channels.

The electricity-heat converters 111 are discharge energy generating elements for generating the heat energy for use in discharging the ink, arranged in parallel one in each of liquid channels 112.

Thus, by driving the electricity-heat converters 111 in accordance with record data, an ink jet recording head 101 for discharging the ink through the discharge ports 110 can be constituted.

In the ink jet recording head 101, if recording failure occurs due to bubbles present on the liquid channels 112 as indicated by a in FIG. 5, or discharge failure occurs due to thickened ink remaining on tip portion of the liquid channels 112 when not used for a long period, bubbles or thickened ink can be exhausted through discharge ports 110 by activating the recovery pump 103. Waste ink exhausted is received into the cap 104 as previously described, and further passed into the waste ink tank 106.

A previously described, in the conventional ink jet recording apparatus, bubbles or thickened ink in the liquid channels 112 are exhausted by activating the recovery pump 103 to apply the pressure to the liquid channels 112 within the recording head 101 and circulate the ink.

In this case, however, if contaminants exist in the vicinity of communicating sections with the ink liquid chamber 114 as indicated by b in FIG. 5, there is a possibility that the contaminants are forced into liquid channels 112 with the applied ink pressure.

If the contaminants are forced into liquid channels 112, the ink can not flow smoothly into the liquid channels 112, thereby causing a recording failure.

SUMMARY OF THE INVENTION

An object of the present invention is to provide an ink jet recording apparatus and recovery method for a recording head which can maintain a stable ink discharge condition.

Another object of the present invention is to provide an ink jet recording apparatus and recovery method for a recording head which can securely remove contaminants from the inside of the recording head.

Another object of the present invention is to provide an ink jet recording apparatus and recovery method for a recording head which can resolve a conventional problem that contaminants present between a filter on the supply side and a filter on the circulation side can not be exhausted, by eliminating the filter on the circulation side by virtue of a back flow prevention means provided in a flow channel of the circulation side.

Another object of the present invention is to provide an ink jet recording apparatus and recovery method for a recording head which can reduce the number of filters and use a wide area of filter without making the recording head larger-sized, wherein a large loss of pressure does not occur even if the mesh of filter is made more finely to densify discharge ports.

Another object of the present invention is to provide an ink jet recording apparatus and recovery method for a recording head which can eliminate cloggings in liquid channels within the recording head, thereby enabling the stable and reliable recording.

DETAILED DESCRIPTION OF THE PREFERRED EMBODIMENTS

The present invention will be described specifically with reference to the drawings.

Figure 2:
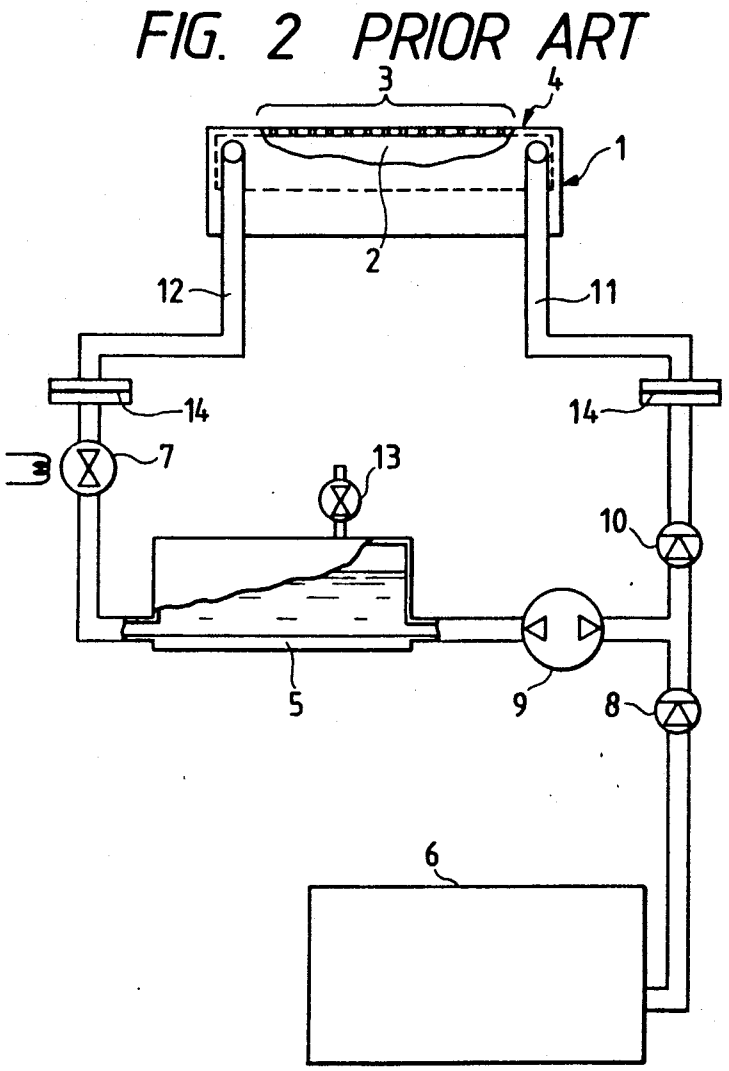
FIG. 2 PRIOR ART
FIG. 2 is a typical view showing another example of the ink supply system in a conventional ink jet recording apparatus.
Figure 1:
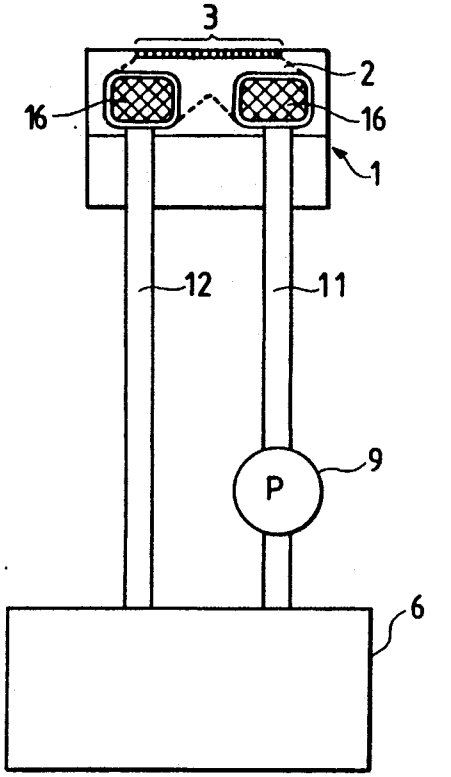
FIG. 1 PRIOR ART
FIG. 1 is a typical view showing an example of the ink supply system in a conventional ink jet recording apparatus.
Figure 3:
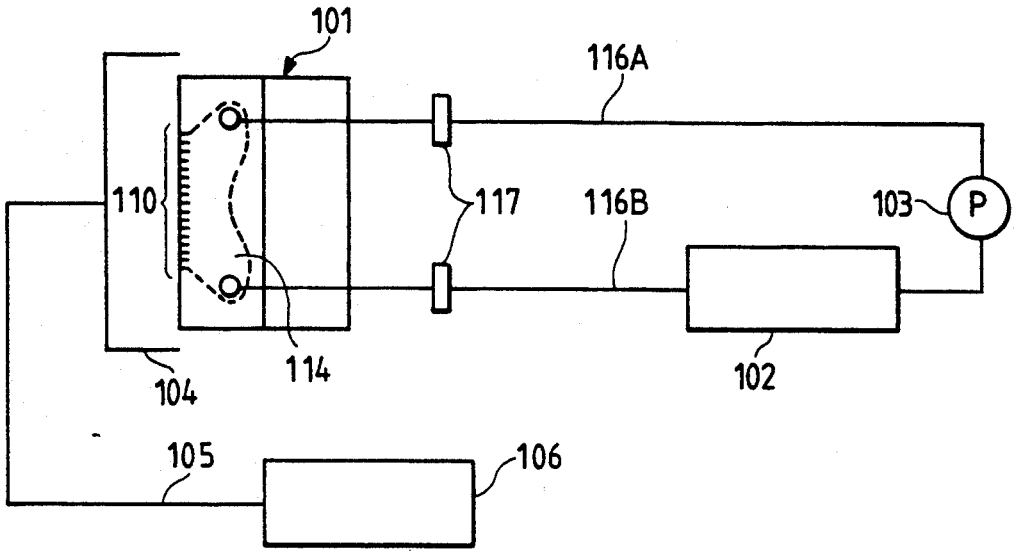
FIG. 3 PRIOR ART
FIG. 3 is a typical view showing a constitutional example of the ink supply system in a conventional ink jet recording apparatus.
Figure 4:
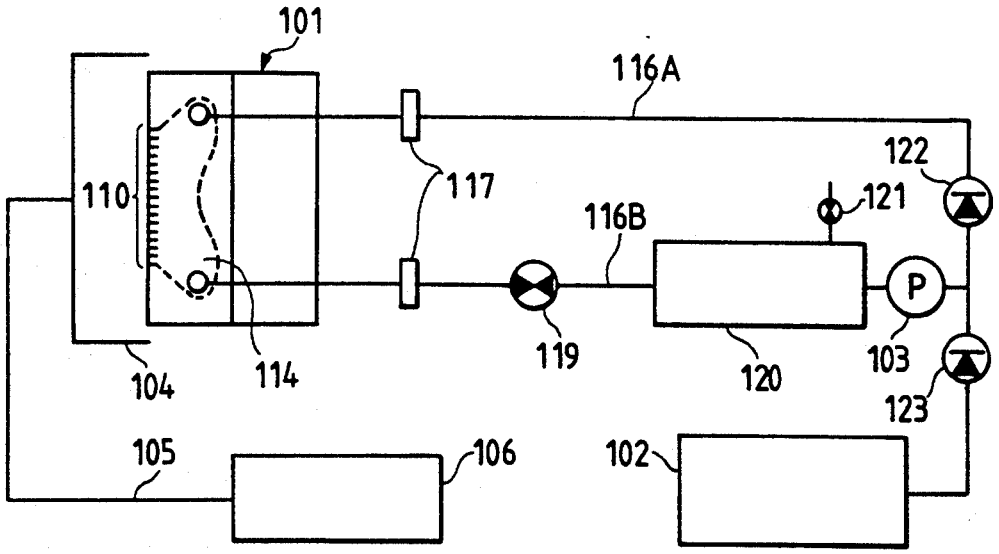
FIG. 4 PRIOR ART
FIG. 4 is a typical view showing another constitutional example of the ink supply system in a conventional ink jet recording apparatus.
Figure 5:
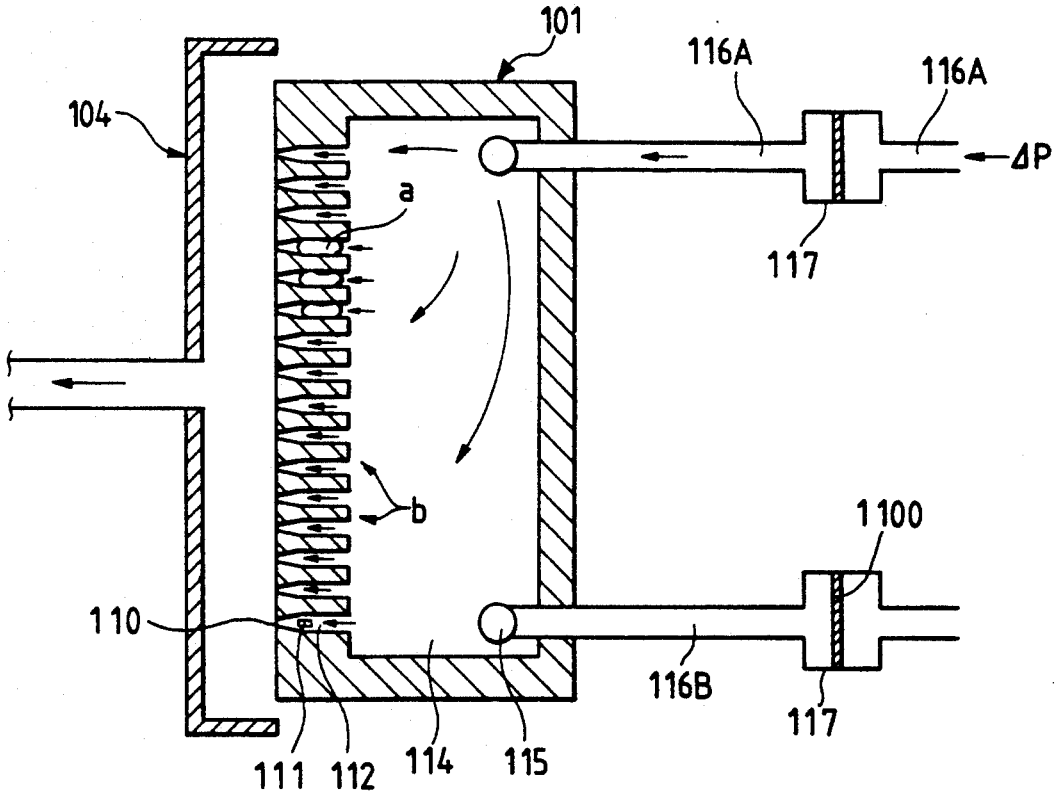
FIG. 5 PRIOR ART
FIG. 5 is a typical cross-sectional view showing the construction of a recording head and a cap as shown in FIG. 3.
Figure 6:
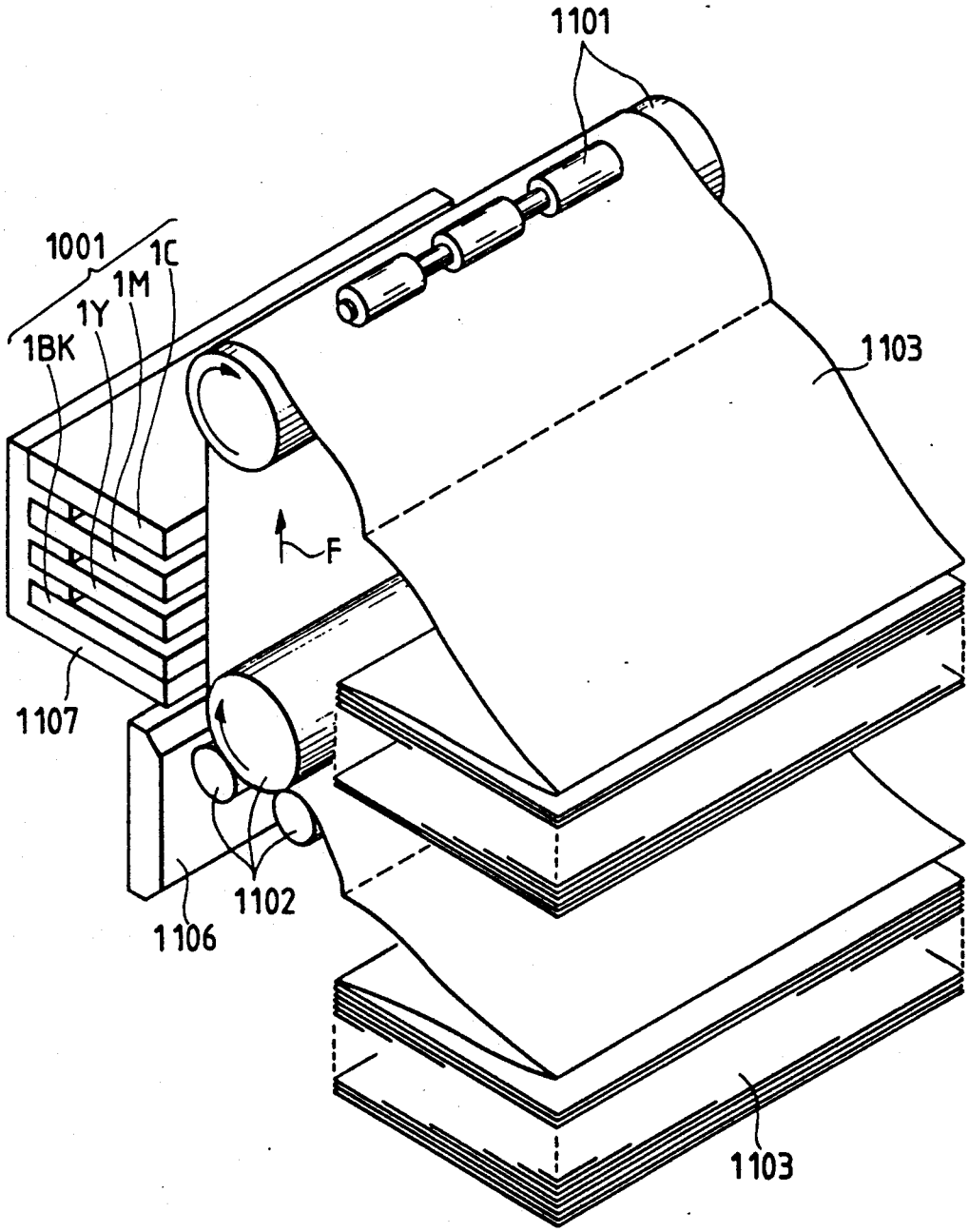
FIG. 6 is a typical perspective view showing an essential part in an example for an ink jet recording apparatus according to the present invention.

First, referring to FIG. 6, an essential constitution in an example for an ink jet recording apparatus to which the present invention is applied will be described. FIG. 6 is a typical perspective view showing the essential constitution of the ink jet recording apparatus to which the present invention is applied.

FIG. 6 shows the ink jet recording apparatus having a plurality of line-type ink jet recording heads (four in the example as shown) arranged to effect the full-line recording.

In FIG. 6, 1101 and 1102 are pairs of rollers for carrying a recording medium 103 such as paper or plastic sheet therebetween, and conveying the recording medium 102 in the sub-scanning direction (conveying direction) as indicated by an arrow F.

1Bk, 1Y, 1M and 1C are multi-type ink jet recording heads having discharge ports arranged almost over the full width of the recording medium 102, respectively, and thereafter each of them generically referred to as (ink jet) recording head 1001. In the full-color recording, colors discharged from the above-mentioned four recording heads are for example black, yellow, magenta and cyan, and in the example as shown, four ink jet recording heads 1001 are arranged from the upstream side of the recording medium conveying direction (from the lower side in the figure) in the above-mentioned sequence.

Numeral 1106 is a recovery system which effects the head recovery operation, as will be described later, by entering between the recording head 1001 and the recording medium 1103 and facing each recording head 1001 as previously indicated in the discharge recovery operation.

Each ink jet recording head 1001 as previously described is mounted to a head mounting section 1107 with positional interrelations being restricted.

As above shown, an ink jet recording apparatus to which the present invention is applied, or which comprises the head mounting section 1107 for mounting the ink jet recording head 1001, and conveying means 1101, 1102 for conveying the recording medium 1103 to a recording position for the recording head 1001 mounted on the above-mentioned head mounting section 1107 can be constituted as one example.

Figure 7:
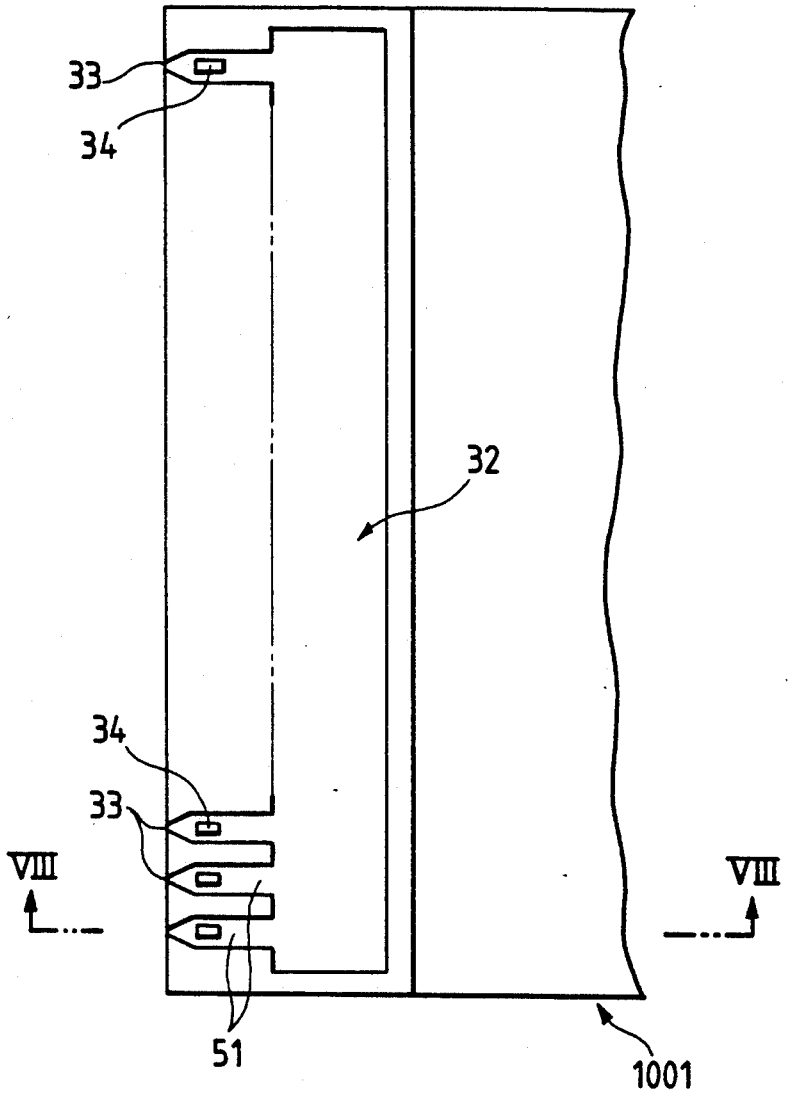
FIG. 7 is a horizontal cross-sectional view of a recording head as shown in FIG. 6.
Figure 8:
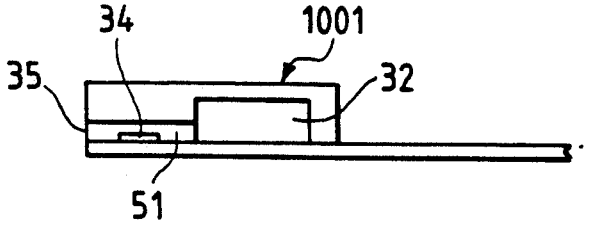
FIG. 8 is a cross-sectional view taken along a line VIII—VIII in FIG. 7.

Further, FIG. 7 is a horizontal cross-sectional view showing typically one example of the above-mentioned ink jet recording apparatus, by omitting a part thereof, and FIG. 8 is a cross-sectional view taken along a line VIII—VIII in FIG. 7.

In FIGS. 7 and 8, the ink jet recording head 1001 comprises a plurality of discharge ports for discharging ink, liquid channels 51 communicating to the respective discharge ports, electricity-heat converters 34 (heat generating elements) disposed in the respective liquid channels 51 for generating the heat energy for use in discharging ink, and a common liquid chamber 32 for reserving the ink to be supplied to the liquid channels 51, in which it discharges ink droplets through the above-mentioned discharge ports 33 and records images onto a recording medium 1103 (paper or plastic sheet).

Figure 9:
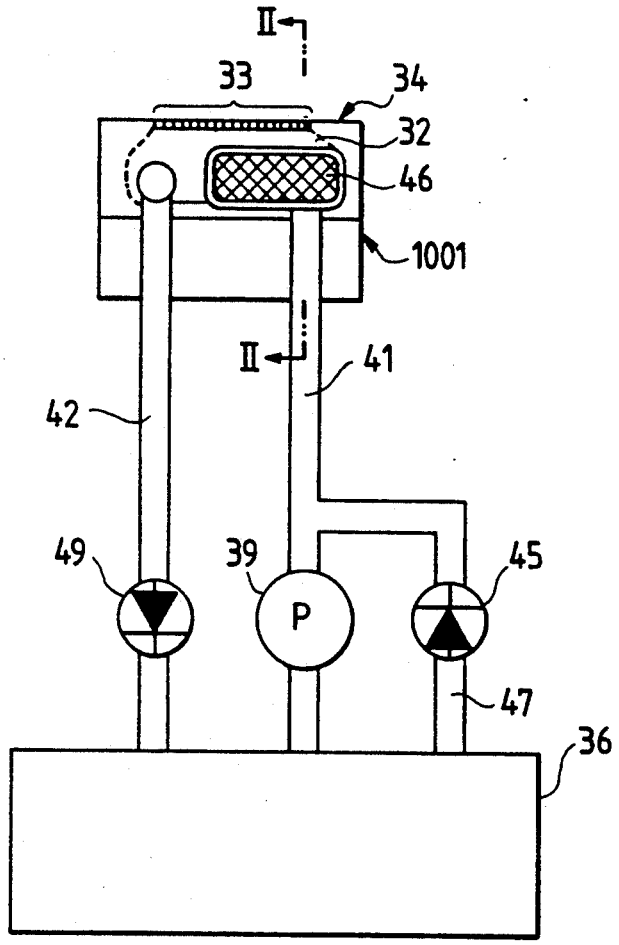
FIG. 9 is a typical view showing the ink supply system in the first example for an ink jet recording apparatus to which the present invention is applied.

That is, the above-mentioned ink jet recording head 1001 can perform the recording by discharging ink through discharge ports with the growth of bubbles owing to the film boiling caused by the heat energy applied from the electricity-heat converters 34. FIG. 9 is a typical view showing the ink supply system in a first example of an ink jet recording apparatus according to the present invention, and FIG. 10 is a partial cross-sectional view taken along a line II—II as shown in FIG. 9.

Figure 10:
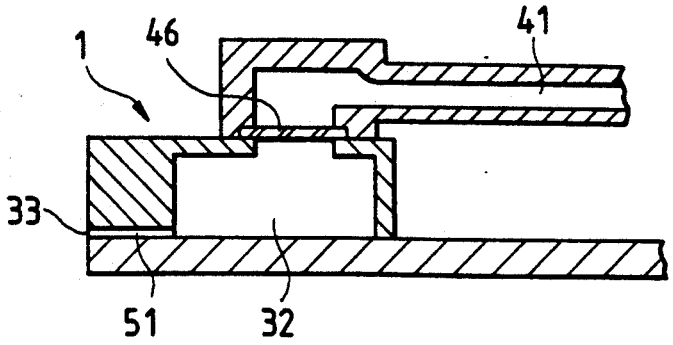
FIG. 10 is a cross-sectional view taken along a line II—II in FIG. 9.

In FIGS. 9 and 10, a storage tank 36 for storing ink and a common liquid chamber 32 in a recording head 1001 are connected via a first flow channel 41 and a second flow channel 42. And a recovery pump 39 is connected to one of the flow channels (first flow channel 41 in the example as shown) for circulating ink to exhaust bubbles in the flow channels or thickened ink within discharge ports (liquid channels).

Further, a third flow channel 47 is connected downstream of the recovery pump 39 provided in the first flow channel and further to the above-mentioned storage tank 36, in the direction from the storage tank 36 toward the recording head 1001. And the above-mentioned first flow channel 41 is provided with a filter 46, which serves to capture contaminants at a tip portion of the above-mentioned flow channel 41 entering into the common liquid chamber 32*a*. (Note that the filter 46 used in this example is a rigi-mesh filter M grade (nominal removal rate 17 μm (98% weight), absolute removal rate 45 μm) made by Pole Inc.)

The filter 46 is more effective if it is located near the discharge section of the recording head 1001 as closely as possible (e.g., liquid channels leading to discharge ports 33), and in the example as shown, it is provided at a junction of the common liquid chamber 32 with the flow channel 41.

In FIG. 9, the third flow channel 47 as previously described is a flow channel through which the ink passes during the recording operation, and midway on the third flow channel is provided a straightening valve (or check valve) 45 for preventing the back flow of ink when the recovery pump 39 is operated.

On the other hand, a straightening valve 49 is provided on the second flow channel 42 as previously described, in order to prevent the ink contained in the storage tank 36 from passing through the flow channel 42 into the common liquid chamber 32.

According to this example, the activation of the recovery pump 39 causes the ink to flow from the storage tank 36 through the first flow channel 41, through the filter 46 into the common liquid chamber 32, and further through the second flow channel 42 back to the storage tank 36.

In this case, as no filter is provided between the common liquid chamber 32 through the second flow channel 42 to the storage tank 36, the flow resistance therebetween is smaller than that in the flow channel 41 which has the filter, so that most of contaminants contained within the common liquid chamber 2 are exhausted into the storage tank 36.

As above described, a method in, which the ink is supplied from one end portion of the common liquid chamber 32 into the recording head 1001 by the recovery pump 39, and circulated from the other end portion of the common liquid chamber 32 into the storage tank 36 is effective to remove bubbles in the flow channels 41, 42 and within the common liquid chamber 32, and more effective particularly when the full-line recording head having a number of discharge ports 33 is used.

On the other hand, during the recording operation, the ink passes from the storage tank 36 through the third flow channel 47, through the first flow channel 41 into the common liquid channel 32, and further through the liquid channels 51 to discharge ports 33, where the ink is discharged as ink droplets onto a recording medium 1103 for the recording.

It should be noted that since the second flow channel 42 is provided with the straightening valve 49, only a small quantity of ink passing back through the straightening valve 49, which can not prevent the inflow of ink completely, is supplied from the second flow channel 42 into the head 1001 with the capillary action therein. Thus, the head 1001 has excellent advantages in the high-speed printing or larger-sized head because contaminants are not supplied to the head 1001.

Thus, the above-mentioned straightening valve 49 constitutes the back flow prevention means which serves to prevent the flow of ink from the storage tank 36 through the second flow channel 42 to the recording head 1001.

In this way, as the back flow prevention means 49 is provided, the ink does not flow from the second flow channel 42 to the common liquid chamber 32 both during the recovery and recording operations, so that contaminants in the storage tank 36 and the second flow channel 42 do not flow into the common liquid chamber 32.

Accordingly, the filter conventionally provided in the second flow channel 42 can be omitted.

On the other hand, contaminants from the first flow channel 41 can be captured by the filter 46.

The number of filters 46 in the circulation path of ink can be less in this example than that in conventional example, thereby enabling larger area of filter to be used and discharge ports 3 to be further densified.

As above described, an ink jet recording apparatus to which one example of the present invention is applied, that is, which records by discharging ink onto a recording medium 1103, is constituted to comprise a recording head 1001, an ink storage tank 36, a first flow channel 41 which can supply the ink from the storage tank 36 to a common liquid chamber 32 of recording head, a second flow channel 42 which can circulate the ink from the above-mentioned common liquid chamber 32 into the storage tank 36, a filter 46 for removing contaminants contained in the ink to be supplied into the common liquid chamber 32, and back flow prevention means 49 provided in the above-mentioned second flow channel. Thus, even if the filter between back flow prevention means 49 and the common liquid chamber 32 is omitted, the clogging within the recording head 1001 can be prevented, and the discharge ports 33 can be further densified without necessity of a large-sized recording head 1001. Note that in this example, ink flow resistance is smaller between the common liquid chamber 32 and back flow prevention means 49 than that in the filter 46 as above mentioned.

Figure 11:
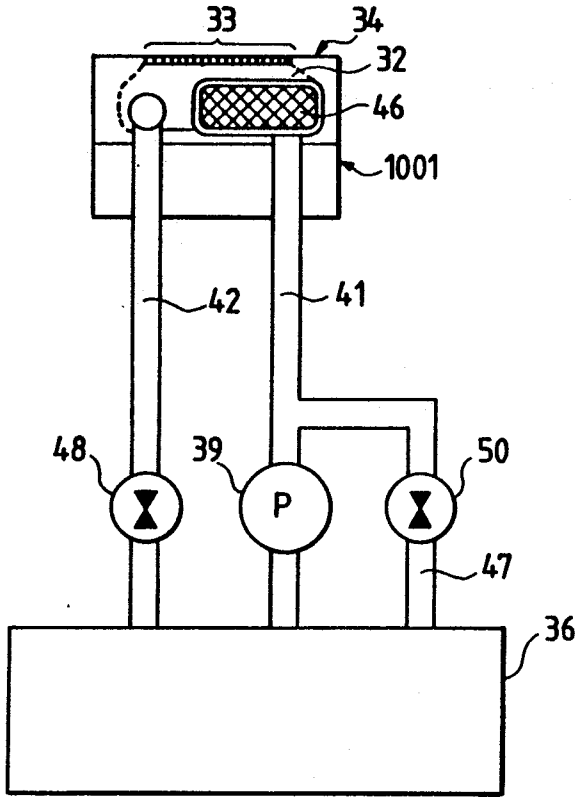
FIG. 11 is a typical view showing the ink supply system in the second example for an ink jet recording apparatus to which the present invention is applied.

FIG. 11 is a typical view showing the ink supply system in a second example for an ink jet recording apparatus to which the present invention is applied.

In this example, a straightening valve 49 in the second flow channel 42 and a straightening valve 45 in the third flow channel 47 in the first example (FIG. 9) are replaced with a solenoid valve 48 and a solenoid valve 50, respectively.

Other portions in this example are substantially the same as those in the first example, wherein like reference numerals are used to refer to like parts, and so detailed description thereof is omitted.

In this example, when activating the recovery pump 39, the solenoid valve 50 is closed and the solenoid valve 48 is opened, while during the recording operation, the solenoid valve 50 is opened and the solenoid valve 48 is closed, so that the same actions and effects can be obtained as in the first example.

An advantage of the present invention is that the flow resistance is reduced at the forward flow while it is increased at the back flow because of the use of solenoid valves in place of straightening valves. Therefore, as even fine contaminants are removed from the head, the clogging of the head can be eliminated securely.

Figure 12:
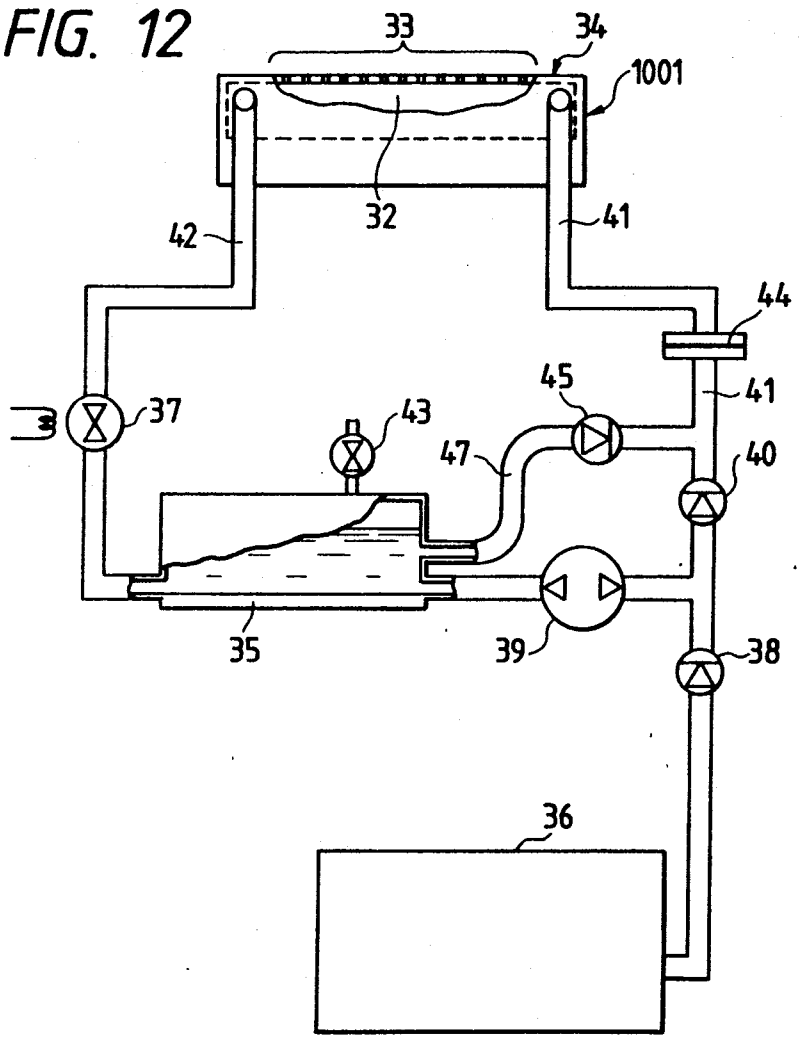
FIG. 12 is a typical view showing the ink supply system in the third example for an ink jet recording apparatus to which the present invention is applied.

FIG. 12 is a typical view showing the ink supply system in a third example for an ink jet recording apparatus according to the present invention.

In this example, a recording tank 35 is provided for the storage tank in addition to a main tank 36. Thus, if the quantity of ink within the recording tank 35 falls below a predetermined value, ink is refilled from the main tank 36 by the activation of a recovery pump 39.

Further, in this example, a straightening valve 38 for refilling ink is provided between the main tank 36 and the recovery pump 39.

At the recovery operation, the ink within the storage tank 35 (recording tank) is circulated through a first flow channel 41 and a second flow channel 42 into a common liquid chamber 32.

The above-mentioned first flow channel 41 is provided with a straightening valve 40 for recovery which passes only the flow toward the common liquid chamber 32, and a filter 44.

On the other hand, the above-mentioned second flow channel 42 is provided with a solenoid valve 37.

Furthermore, the above-mentioned storage tank 35 is connected with a third flow channel 47 for supplying ink during recording.

The other end (end portion downstream) of the third flow channel 47 is connected midway the above-mentioned flow channel 41 and between the above-mentioned straightening valve 40 and the above-mentioned filter 44.

And midway the above-mentioned third flow channel 47 is provided a straightening valve 45 for supplying ink.

In this example, the ink in the first flow channel 41 and within common liquid chamber 32 can be exhausted without being returned to the storage tank 35, by activating the recovery pump 39 with the solenoid valve 37 closed.

Note that numeral 34 indicates a discharge port face on which discharge ports 33 of the recording head 1001 are arranged, and numeral 43 indicates an air vent valve for the storage tank 35.

According to the present invention, the activation of the recovery pump 39 causes the ink to flow from the storage tank (recording tank) 35 through the first flow channel 41, through the filter 44 into the common liquid chamber 32, and further through the second flow channel 42 back to the storage tank 35.

In this case, as no filter is provided between the common liquid chamber 32 through the second flow channel 42 to the storage tank 35, most of contaminants contained within the common liquid chamber 32 are exhausted into the storage tank 35.

As above described, a method in which the ink is supplied from one end portion of the common liquid chamber 32 into the recording head 1001 by activation of the recovery pump 39, and circulated from the other end portion of the common liquid chamber 32 into the storage tank 35 is effective to remove bubbles in the flow channels 41, 42 and within the common liquid chamber 32, and more effective particularly when the full-line recording head having a number of discharge ports 33 on the discharge port face 34 is used.

On the other hand, during the recording operation, the ink passes from the storage tank 35 through the third flow channel 47, through the first flow channel 41, through the filter 44 into the common liquid channel 32, and further through the liquid channels 51 to discharge ports 33, where the ink is discharged as ink droplets onto a recording medium 1103 for the recording.

It should be noted that since the second flow channel 42 is provided with the solenoid valve 37, the ink is not supplied from the second flow channel 42 if the solenoid valve 37 is closed during recording. That is, the above-mentioned solenoid valve 37 constitutes the back flow prevention means which serves to prevent the flow of ink from the storage tank 35 through the second flow channel 42 to the recording head 1001.

In this way, as the back flow prevention means 37 is provided, ink does not flow from the second flow channel 42 to the common liquid chamber 32 if the back flow prevention means 37 is controlled to open only when there is no fear that the back flow will occur. Thus, contaminants in the storage tank 35 and the second flow channel 42 does not flow into the common liquid chamber 32.

Accordingly, in this example, the second flow channel 42 does not need to have any filter.

On the other hand, contaminants passing through the first flow channel 41 into the recording head 1001 can be captured by the filter 44.

Note that in place of the straightening valve 45 for supplying ink in FIG. 12, a solenoid valve can be used.

With the constitution of FIG. 12 as above described, there is provided an ink jet recording apparatus according to the present invention, that is, which records by discharging ink onto a recording medium 1103, wherein it comprises a recording head 1001, an ink storage tank 35, a first flow channel 41 which can supply the ink from the storage tank 35 to a common liquid chamber 32 of recording head, a second flow channel 42 which can circulate the ink from the above-mentioned common liquid chamber 32 into the storage tank 35, a filter 44 for removing contaminants contained in the ink to be supplied into the common liquid chamber 32, and back flow prevention means 37 provided in the above-mentioned second flow channel.

With such constitution, even if a filter between back flow prevention means 37 and the common liquid chamber 32 is omitted, the clogging of contaminants within the recording head 1001 can be prevented, whereby the reliability of the recording head 1001 can be improved and by reducing the probability of ink discharge failure due to the clogging of contaminants in the liquid channels 51. Further, the number of filters 44 can be reduced and the discharge ports 33 can be further densified without necessity of a larger-sized recording head 1001.

A further example of the present invention will be described.

In the example that will be described, the recovery efficiency can be improved by enclosing discharge ports during the recovery operation.

Figure 13:
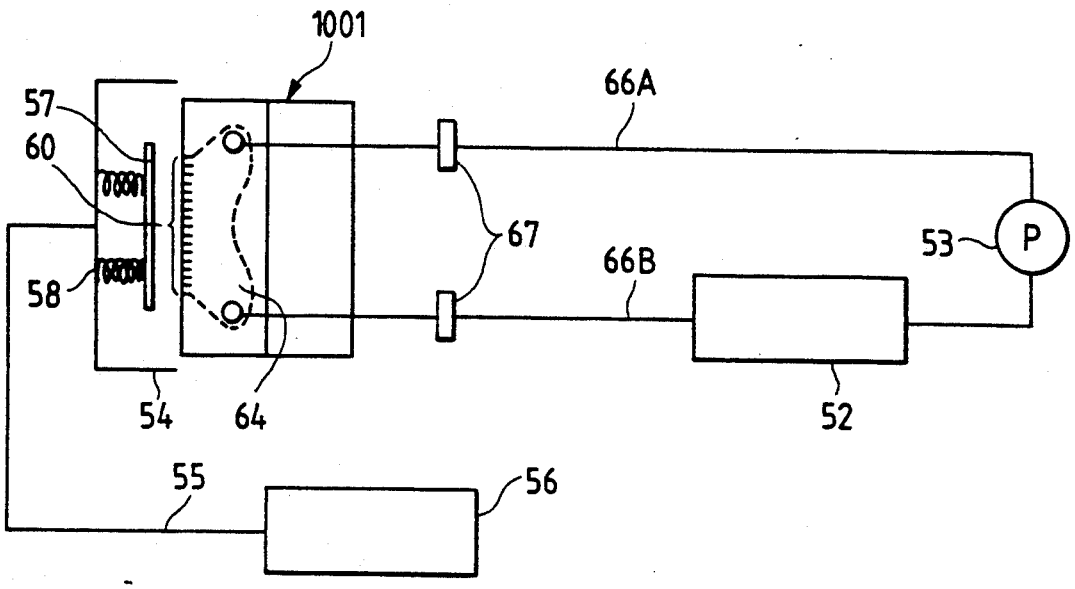
FIG. 13 is a typical view showing the ink supply system in the fourth example for an ink jet recording apparatus to which the present invention is applied.

Further, FIG. 13 is a typical view showing the ink supply system in a fourth example for an ink jet recording apparatus to which the present invention is applied.

In FIG. 13, a recording head (ink jet recording head) 1001 is provided with an ink liquid chamber 64 capable of reserving ink, and a plurality of discharge ports 60 for discharging ink flowing in from the ink liquid chamber, wherein the discharge ports 60 and the ink liquid chamber 54 are communicated via liquid channels where discharge energy generating elements (electricity-heat converters such as heat generating elements) are disposed.

A main tank 52 for storing ink and the ink liquid chamber 64 in the recording head 1001 are connected via a first ink flow channel 66A and a second ink flow channel 66B, to one of which (first flow channel 66A in the example as shown) is connected a recovery pump 53 for exhausting bubbles within the recording head 1001 or in the flow channels 66A, 66B, or thickened ink within discharge ports (liquid channels) by feeding ink into the recording head 1001.

The flow channels 66A, 66B are provided with filters 67, 67, respectively, to capture contaminants.

As above described, ink circulating means for supplying ink from one end portion of the ink liquid chamber 64 by activation of the recovery pump 53 and circulating the ink from the other end portion of the ink liquid chamber 64 back into the main tank 52 is effective to recover the head 1001 by removing bubbles or contaminants in the ink channels 66A, 66B and within the ink liquid chamber 64, and more effective particularly when the full-line recording head having a number of discharge ports 60 is used.

In the ink supply system in the fourth example as shown in FIG. 13, as the flow channel resistance in the recovery pump 53 is large during the recording operation, the ink flows from the main tank 52 through the second flow channel 66B into the recording head 1001.

When the ink is circulated into the ink liquid chamber 64 by activating the above-mentioned recovery pump 53, the recovery function of the liquid channels or discharge ports 60 is effected by exhausting a partial quantity of ink from discharge ports 60 and removing cloggings produced therein together with bubbles and so on as previously described.

Thus a cap 54 for receiving ink exhausted from discharge ports 60 is provided On the side opposed to the recording head 1001, and in which it faces the recording head 1001.

The ink exhausted into the cap 54 is passed through a waste ink flow channel 55 into a waste ink tank 56.

An ink jet recording apparatus to which the present invention is applied is provided with discharge port sealing means within the above-mentioned cap 54, which can seal the discharge ports 60 by tightly enclosing the discharge ports 60 of the recording head 1001.

The discharge port sealing means is comprised of a presser plate 57 which is a lid for covering all of the discharge ports by tightly enclosing the discharge port face, and springs 58 between the cap 54 and the presser plate 57 for biasing the presser plate 57 toward the discharge port face. Note that a side of the above-mentioned presser plate 57 opposed to the discharge port face is rendered semi-cylindrical, in which the discharge ports 60 can be enclosed by the semi-cylindrical ridge line portion completely. At least a face for enclosing discharge ports of the above-mentioned presser plate 7 is made of, for example, a sealing material such as rubber.

Figure 14A:
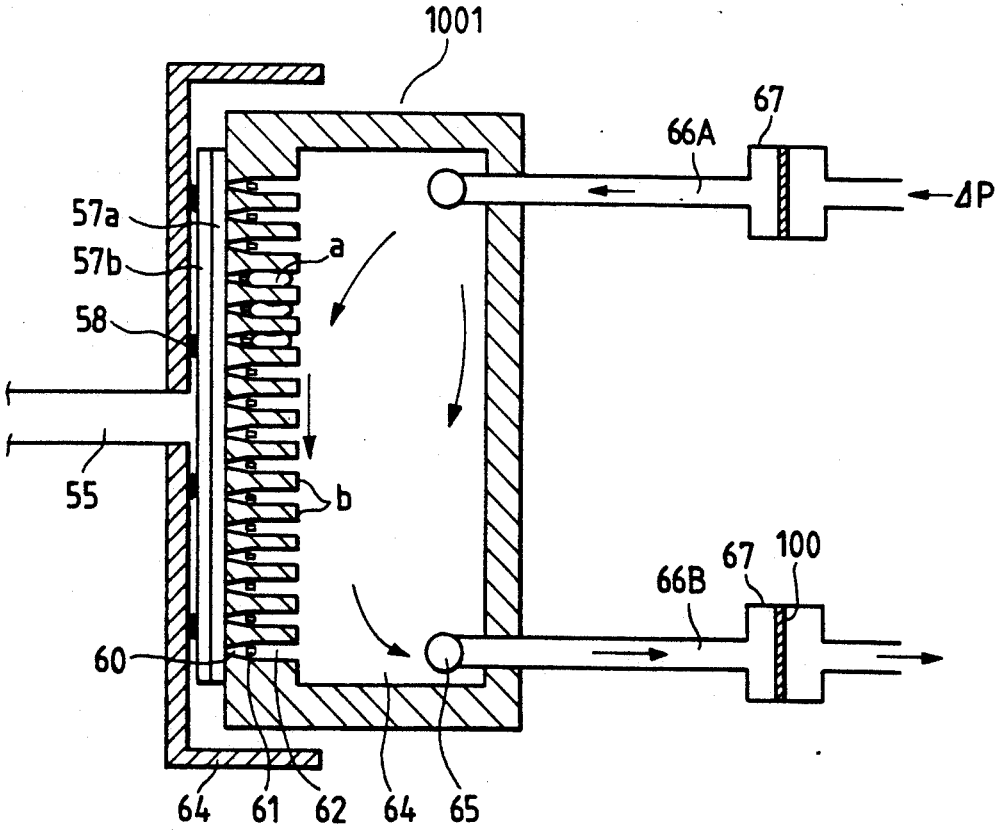
FIG. 14A and 14B are cross-sectional views showing the detailed construction and operation for a recording head and a cap as shown in FIG. 13.
Figure 14B:
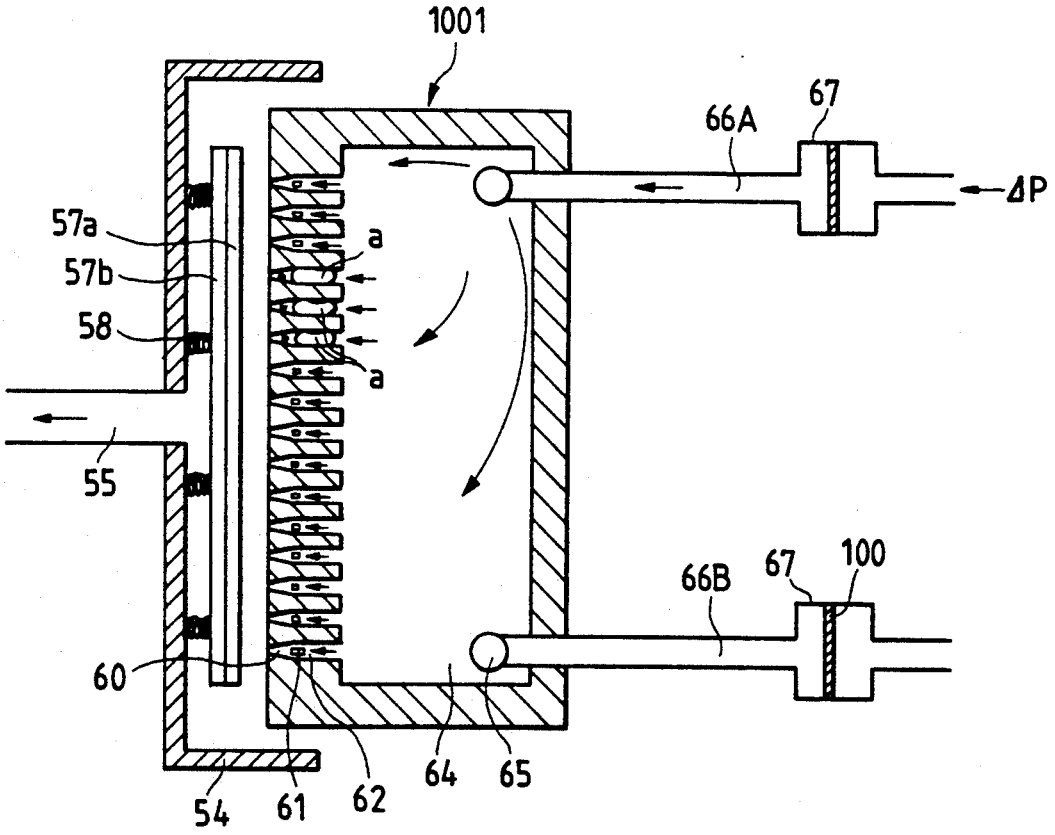

FIG. 14 is a cross-sectional view showing the detailed construction for the recording head 1001 and the discharge port sealing means 57, 58 as shown in FIG. 13, wherein (A) shows a state of enclosing the discharge ports 60 so that ink may not leak through the discharge ports 60 (capping position A), and (B) shows a state of opening the discharge ports 60 in order to remove bubbles or other contaminants present in the liquid channels 62 while the capping is maintained with the cap 54 (retracted position B), that is, a state of retracting the discharge port sealing means to a position where the discharge ports 60 are opened with the presser plate 57 being spaced away from the discharge ports 60 while the cap 54 maintains the capping for the head 1001.

In FIG. 14, the recording head 1001 comprises an ink liquid chamber 64, a plurality of liquid channels 62 communicating to the ink liquid chamber 64, a plurality of discharge ports 60 formed at tip openings of liquid channels, and electricity-heat converters 61 such as heat generating elements each of which is disposed in each of the liquid channels 62.

Note that the electricity-heat converters 61 are discharge energy generating elements for generating the heat energy for use in discharging the ink, arranged in parallel with one in each of liquid channels 62.

Thus, an ink jet recording heat 1001 for discharging ink through the discharge ports 60 can be constituted by driving the above-mentioned electricity-heat converters 61 in accordance with record data.

The above-mentioned presser plate 57 in this example is comprised of an elastic sealing plate 57*a* made of, for example, silicone rubber, and a semi-cylindrical back plate 57*b* made of steel such as SUS.

Next, the generation of the discharge port sealing means will be described.

When the recovery pump 53 is to be operated, the discharge ports 60 must be tightly sealed by bringing the cap 54 closer to the recording head 1001 and enclosing the discharge port face with the presser plate 57, prior to driving the recovery pump 53.

Note that the cap driving device (FIG. 17) for driving the cap 54 is a gear mechanism, for example, consisting of rack and pinion having a motor as the driving source and transmitting the driving force of the motor to the cap 54.

In this way, after enclosing the discharge ports 60, the recovery pump 53 can be operated.

Then, the flow of ink within the ink liquid chamber 64 is as indicated by an arrow in the figure (A), and in the vicinity of trailing portion b of each liquid channel, i.e., communicating portion b to the ink liquid chamber 64, the ink flows in the direction almost at right angles to the liquid channel. Thus, contaminants in the vicinity of liquid communicating portions b or within the ink liquid chamber 64 are exhausted from outlet port 65 of the ink liquid chamber 64 through the second ink flow channel 66B together with circulating ink and without passing into liquid channels 62.

Afterwards, the discharge ports 60 are opened by separating the cap 54 off the recording head 1001 and then the presser plate 57 of discharge port sealing means away from the discharge port face as shown in (B).

At this time, bubbles present in the liquid channels 62 are exhausted through discharge ports together with the ink.

In the state of (B), contaminants on the trailing portions of liquid channels 62 or within the ink liquid chamber 64 have been removed, and thus no contaminants pass into the liquid channels 62.

The ink exhausted through the discharge ports 60 and received within the cap 54 are passed through the waste ink flow channel 55 into the waste ink tank 56. Note that during recording, the presser plate 57 and the head 1001 are more spaced from each other than they are as shown in the figure, so as to allow the entry of recording medium (retracted position C). In such a case, the presser plate 57 may be moved either vertically or horizontally with respect to the head 1001, or the head 1001 may be moved.

Upper and lower sides in FIG. 14 do not need to coincide with those for an actual recording apparatus, and then the constitution as shown can be used regardless of its orientation.

Figure 15:
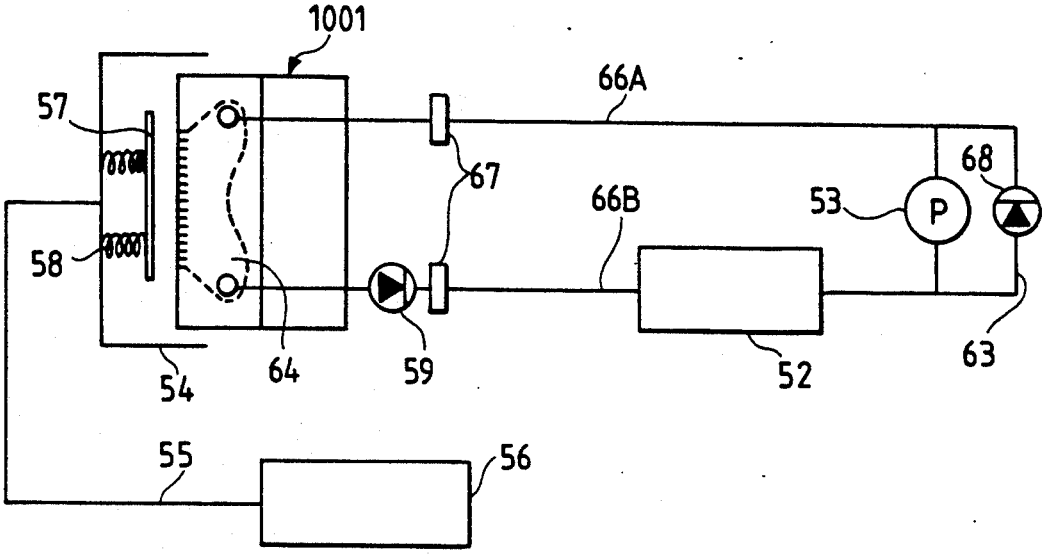
FIG. 15 is a typical view showing the ink supply system in the fifth example for an ink jet recording apparatus to which the present invention is applied.

FIG. 15 is a typical view showing the ink supply system in a fifth example for an ink jet recording apparatus to which the present invention is applied.

In this example, a straightening valve 59 for preventing the back flow is provided between the above-mentioned ink liquid chamber 64 and the above-mentioned filter 67 in the second ink flow channel 66B, in addition to the fourth example as shown in FIG. 13. Further, a bypass ink flow channel 63 for bypassing the recovery pump 53 is provided, in which the bypass ink flow channel comprises a straightening valve 68.

In the previously-described fourth example, during the recovery operation, contaminants exhausted from the ink liquid chamber 64 may be collected in front of the filter 67 in the second ink flow channel 66B, and so the contaminants collected therein may be flowed backward into the ink liquid chamber 64 during the recording operation.

Thus, in this example, the back flow of contaminants is prevented by providing the straightening valve 59 between the ink liquid chamber 64 and the filter 67, so that cloggings in the liquid channels 62 during recording can be prevented more completely.

Considering that the first ink flow channel 66A is the ink supply path during recording, the bypass ink flow channel 63 for bypassing the recovery pump 53 is provided in order to avoid the loss of pressure in the ink flow channel 66A with the recovery pump 53, and to make the supply of ink smooth during recording.

Further, the straightening valve 68 as previously described is provided so that the ink can not flow through the abovementioned bypass ink flow channel 63 during the operation of the recovery pump 53.

This example differs in the above points from the fourth example as previously described, but other portions are substantially the same, wherein like reference numerals are used to refer to like parts, and SO detailed description thereof is omitted.

In this example, like previous examples, on the side opposed to the recording head 1001 is placed a cap 54, within which is provided discharge port sealing means which can seal the discharge ports 60 by tightly enclosing the discharge ports 60 of the recording head 1001.

The discharge port sealing means is comprised of a presser plate 57 which is a lid for covering all of the discharge ports by tightly enclosing the discharge port face, and springs 58 for urging under pressure the presser plate 57 toward the discharge port face.

Accordingly, in this example, like previous examples, in the first half for operating the recovery pump 53, contaminants within the ink liquid chamber 64 are exhausted by circulating the ink with the discharge ports 60 being sealed by the abovementioned presser plate 57. And in the latter half, contaminants or bubbles in the liquid channels can be removed by discharging the ink through discharge ports 60 with the presser plate 57 being released.

Figure 16:
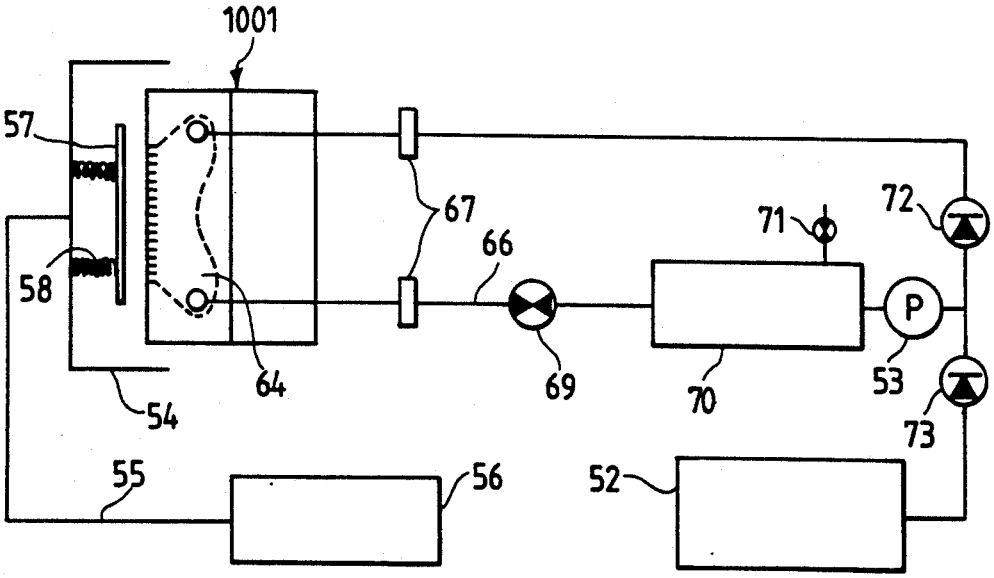
FIG. 16 is a typical view showing the ink supply system in the sixth example for an ink jet recording apparatus to which the present invention is applied.

Furthermore, FIG. 16 is a typical view showing the ink supply system in a sixth example for an ink jet recording apparatus to which the present invention is applied.

In this example, a recording liquid supply tank 70 is provided in addition to a main tank 52 in the constitution according to the fourth example as shown in FIG. 13, in which if the ink within the recording liquid supply tank 70 falls below a predetermined quantity, the ink is refilled from the main tank 52 through a straightening valve 73 for refilling by recovery pump 53. Further, a straightening valve 72 for recovery is provided in the first ink flow channel 66A, while a solenoid valve 69 is provided between the above-mentioned recording liquid supply tank 70 and the filter 67 in the second ink flow channel 66B.

Note that the recording liquid supply tank 70 is provided with an air vent valve 71.

The ink supply system in the sixth example as shown in FIG. 16 differs in the above points from that in the fourth example as shown in FIG. 13, but other portions are constituted substantially in the same way, wherein like reference numerals are used to refer to like parts, and so detailed description thereof is omitted.

In this example, the ink in the first ink flow channel 66A and within the ink liquid chamber 64 can be exhausted through discharge ports 60 without being returned to the recording liquid supply tank 70, by activating the recovery pump 53 with the solenoid valve 69 closed.

Also in the constitution as shown in FIG. 16, like previous examples, on the side opposed to the recording head 1 is provided a cap 5, within which is disposed discharge port sealing means for sealing the discharge ports by tightly enclosing the discharge ports 60 of the recording head 1001.

As previously described, the discharge port sealing means is comprised of a presser plate 57 which is a lid for covering whole of the discharge ports by tightly enclosing the discharge port face, and springs 58 for urging under pressure the presser plate 57 toward the discharge port face.

Accordingly, in this example, like previous examples, in the first half for operating the recovery pump 53, contaminants within the ink liquid chamber 64 are exhausted by circulating the ink with the discharge ports 60 being sealed by the abovementioned presser plate 57. And in the latter half, contaminants or bubbles in the liquid channels can be securely removed by discharging the ink through discharge ports 60 with the presser plate 57 being released.

Also in the fifth and sixth examples as described, like the fourth example as previously described with reference to FIG. 14, contaminants present in the vicinity of inlet ports of the liquid channels for the recording head (in the neighborhood of position b in FIG. 14) were effectively prevented from being forced into the liquid channels 62 during operation of the recovery pump, thereby causing recording failure.

At the same time, foreign matters such as bubbles or contaminants in the liquid channels 62 can be exhausted through the discharge ports 60 together with ink, so that further secure recovery operations were enabled and the reliability of ink jet recording head and the stability of recording operation could be improved.

Figure 17:
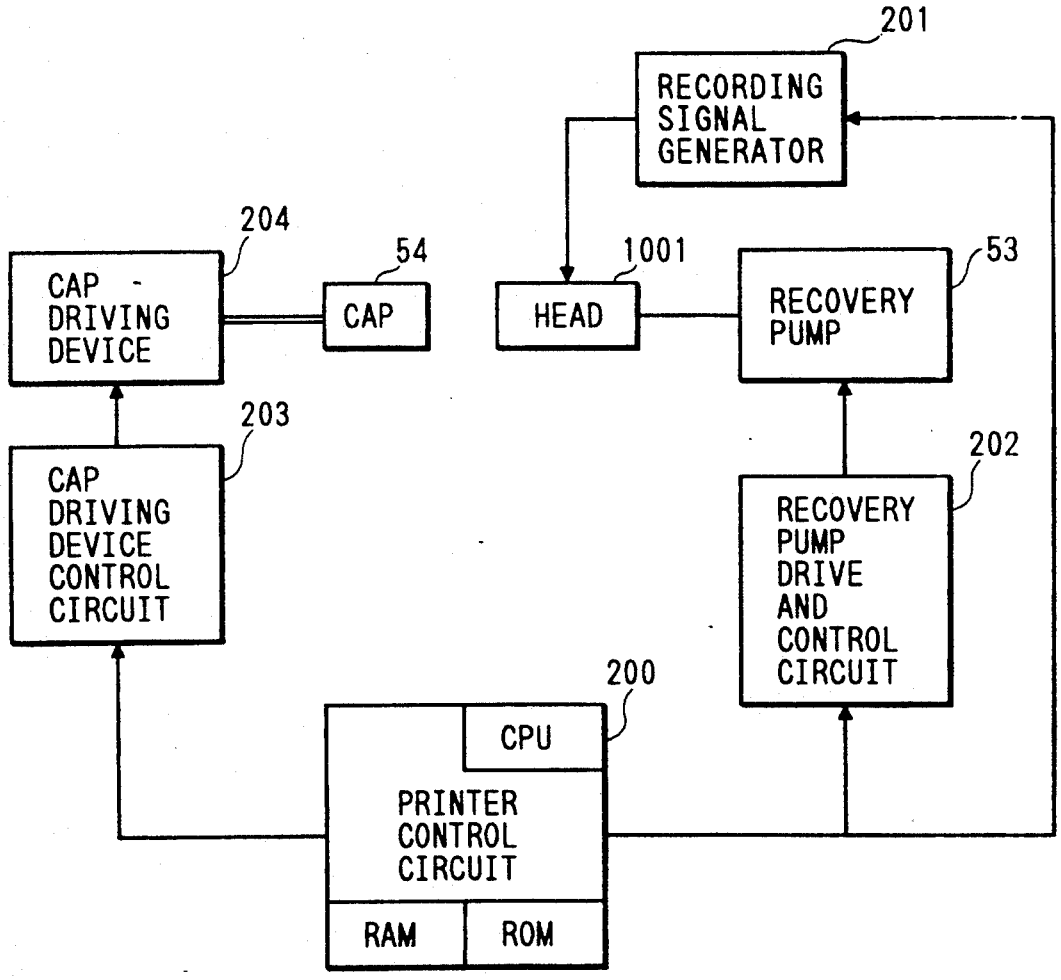
FIG. 17 is a block diagram for the fourth to sixth examples as above shown.

Referring now to FIG. 17, a functional block diagram showing a schematic functional constitution for an ink jet recording apparatus according to the fourth to sixth examples as previously described will be described.

Figure 18:
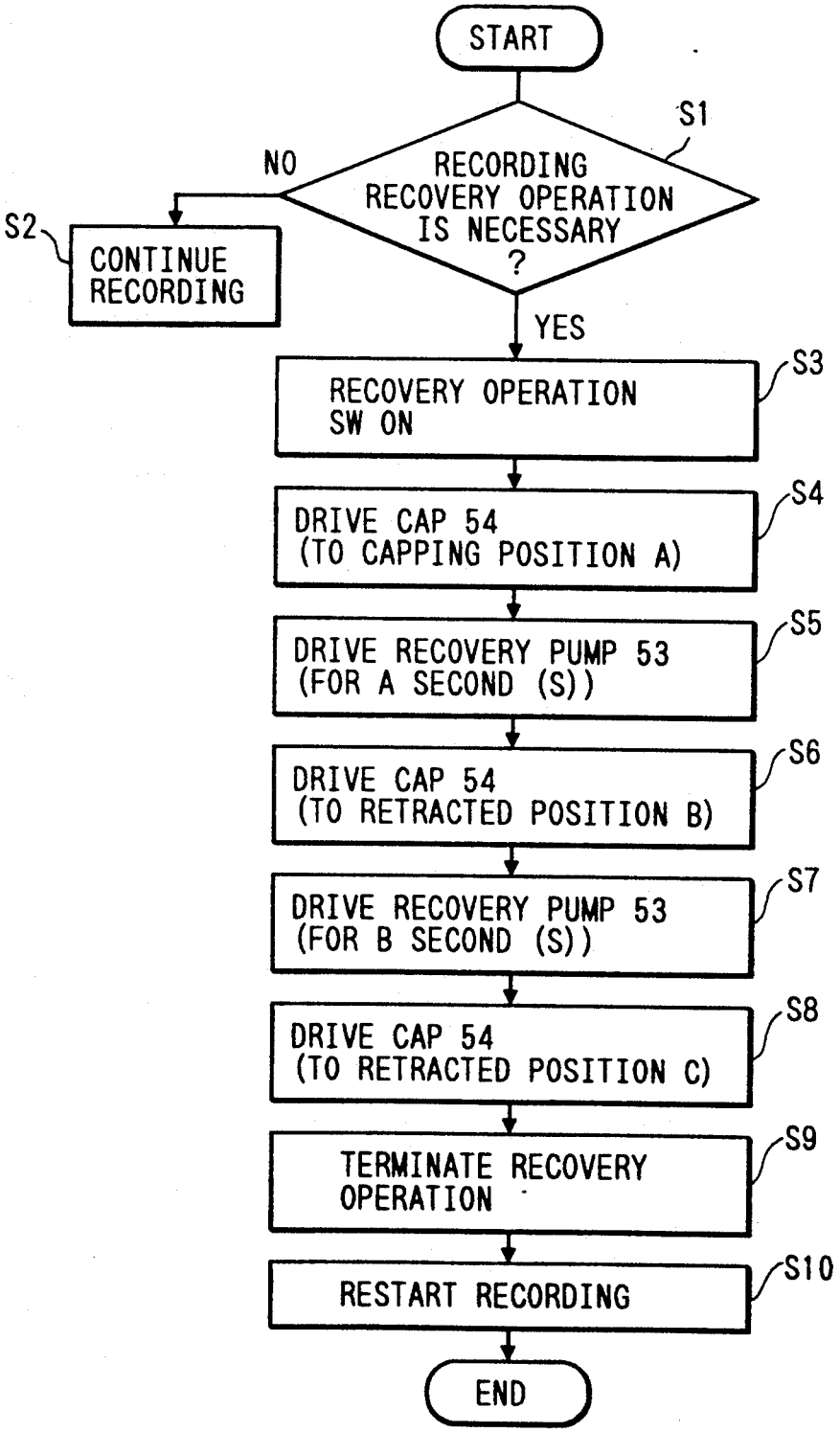
FIG. 18 is a flowchart associated with the above-described diagram.
Figure 19:
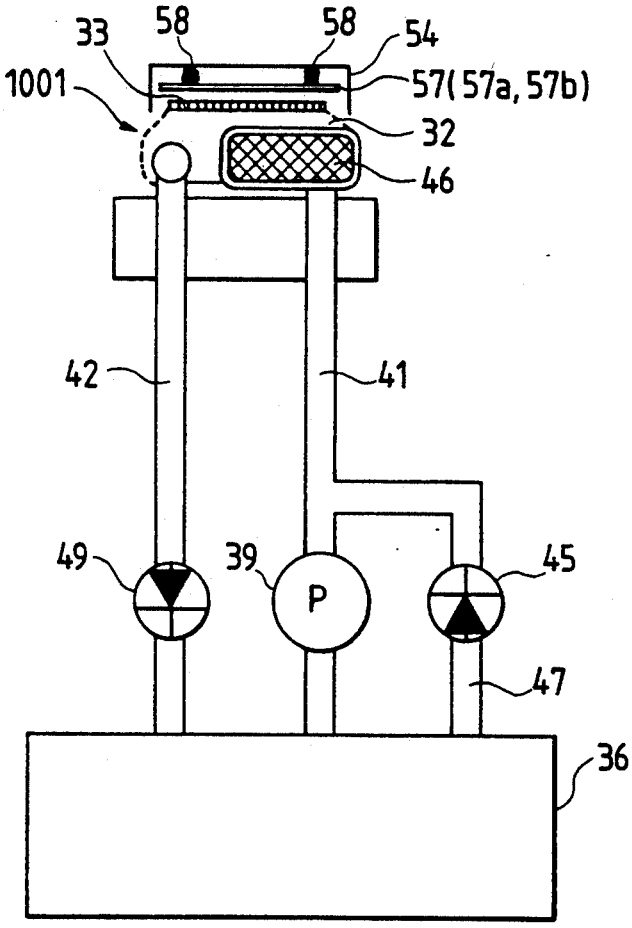
FIG. 19 is a typical view showing the seventh example.

In the figure, 200 is a control section for controlling the whole system, comprising a CPU for a microprocessor, for example, a ROM for storing control programs for the CPU as shown in a flowchart of FIG. 18, and various data, and a RAM for use in temporary storage of various data as well as a work area for the CPU as above described. A control signal issued from the control section 200 is transmitted via recording signal generator 201, recovery pump drive and control circuit 202, and cap driving device control circuit 203 to drive and control a head 1001, a recovery pump 53, and cap driving device 204 and a cap 54, respectively.

FIG. 18 is a flowchart showing the procedure for the recovery operation in the fourth to sixth examples as previously described.

First, at step 1 (S1), whether or not a recording recovery operation is necessary is determined. If not necessary, the recording is continued at step 2 (S2). If the decision is necessary, the recovery operation as shown in steps 3 (S3) to 9 (S9) is performed. At step 3 (S3), a recovery operation switch is turned on, and a cap 54 is driven to the capping position A (step 4). Next, at step 5 (S5), recovery pump 53 is driven for A seconds (for example, about 0.5 second in this example) to circulate ink in the ink circulation passage. Next, at step 6 (S6), the cap 54 is driven to the retracted position B. Then in this sate, the recovery pump 53 is driven for B seconds (for example, about 0.2 second in this example) to discharge ink through discharge ports 110 of head 1001 (step 7). Then, at step 8, the cap 5 is further driven to the retracted position C. Thus the recovery operation is terminated (step 9), and the recording is restarted (step 10). To make the above description more distinct, note that the capping position A indicates a state where the cap 54 applies the capping on the head so that discharge ports 110 are closed by presser plate 57 (state of closing the discharge ports 110), the retracted position B indicates a state where the cap 54 applies the capping on the head while the pressing of presser plate 57 against discharge ports 110 are released (state of opening the discharge ports), and the retracted position C indicates a state where the cap 54 is released from the head and so the discharge ports are opened.

Now, a seventh example will be described.

The example as will be described is a combination of the first example and the fourth example, and according to this example, more reliable recovery operation for a head can be effected without consuming ink wastefully.

Note that like reference numerals are used to refer to parts with the same functions as those in the previously described examples, and description thereof can be quoted.

As shown, this example is constituted by adding a head cap 54 and a head presser plate 57 to an ink jet recording apparatus as shown in the first example. Note that in this example, the timing at which the cap is placed at the retracted position B during the recovery operation is after the ink within head 1001 arrives at tank 36. And the head cap 54 and the head presser plate 57 are ones performing the same operations as those in the third example as previously described. According to this example, the recovery operation of head can be performed with a reduced number of filters and without discharging the ink wastefully.

It should be noted that in the above described examples, the present invention was applied to an ink jet recording apparatus having a line-type recording head, but it could be also practiced in an ink jet recording apparatus having a serial-type recording head in which the recording head is conveyed over recording medium by being mounted on a carriage, with the same effects.

The present invention brings about excellent effects particularly in an ink jet recording apparatus having an ink jet recording head of the ink jet system provided with means for generating the heat energy (for example, electricity-heat converters or laser beam) as the energy for use in discharging ink and causing the state change of ink with that heat energy among the various ink jet recording systems.

As to its representative constitution and principle, for example, one practiced by use of the basic principle disclosed in, for example, U.S. Pat. Nos. 4,723,129 and 4,740,796 is preferred This system is applicable to either of the so-called on-demand type and the continuous type. Particularly, the case of the on-demand type is effective because, by applying at least one driving signal which gives rapid temperature elevation exceeding nucleate boiling corresponding to the recording information on electricity-heat converters arranged corresponding to the sheets or liquid channels holding a liquid (ink), heat energy is generated at the electricity-heat converters to effect film boiling at the heat acting surface of the recording head, and consequently the bubbles within the liquid (ink) can be formed corresponding one by one to the driving signals.

By discharging the liquid (ink) though an opening for discharging by growth and shrinkage of the bubble, at least one droplet is formed.

By making the driving signals into pulse shapes, growth and shrinkage of the bubble can be effected instantly and adequately to accomplish more preferably discharging of the liquid (ink) particularly excellent in response characteristic. As the driving signals of such pulse shape, those as disclosed in U.S. Pat. Nos. 4,463,359 and 4,345,262 are suitable.

Further excellent recording can be performed by employment of the conditions described in U.S. Pat. No. 4,313,124 of the invention concerning the temperature elevation rate of the abovementioned heat acting surface.

As the constitution of the recording head, in addition to the combination of the discharging orifice, liquid channel, and electricity-heat converter (linear liquid channel or right-angled liquid channel) as disclosed in the above-mentioned respective specifications, the constitution by use U.S. Pat. Nos. 4,558,333, or 4,459,600 disclosing the constitution having the heat acting portion arranged in the flexed region is also included in the present invention.

In addition, the present invention can be also effectively made like the constitution as disclosed in Japanese Laid-Open Patent Application No. 59-123670 which discloses the constitution using a slit common to a plurality of electricity-heat converters as the discharging portion of the electricity-heat converter or Japanese Laid-Open Patent Application No. 59-138461 which discloses the constitution having the opening for absorbing pressure wave of heat energy correspondent to the discharging portion.

Further, as the recording head of the full line type having a length corresponding to the maximum width of a recording medium which can be recorded by the recording device, either the constitution which satisfies its length by a combination of a plurality of recording heads as disclosed in the above-mentioned specifications or the constitution as one recording head integrally formed may be used.

In addition, the present invention is effective for a recording head of the freely exchangeable chip type which enables electrical connection to the main device or supply of ink from the main device by being mounted on the main device, or a recording head of the cartridge type having an ink tank integrally provided on the recording head itself.

Also, the addition of a restoration means for the recording head, a preliminary auxiliary means, etc. is preferable, because the effect of the present invention can be further stabilized.

Specific examples of these may include, for the recording head, capping means, cleaning means, pressurization or suction means, electricity-heat converters or another type of heating elements, or preliminary heating means according to a combination of these, and it is also effective for performing stable recording to perform a preliminary recovery mode which performs discharging separate from recording.

Further, as the recording mode of the recording device, the present invention is extremely effective for not only the recording mode only of a primary color such as black etc., but also a device equipped with at least One of plural different colors or full color by color mixing, whether the recording head may be either integrally constituted or combined in plural number.

Although the ink is considered as a liquid in the examples of the present invention as described above, other ink is also sufficiently used if it stiffens below the room temperature and softens or liquefies at the room temperature, or liquefies when a recording enable signal is issued as it is commonly practiced in the ink jet system to control the viscosity of ink to be maintained within a certain range for the stable discharging by adjusting the temperature of ink in the range from 30° C. to 70° C.

In addition, the ink which has the property of liquefying only with the application of heat energy is also applicable to the present invention, wherein the ink will liquefy with the heat energy applied in accordance with a record signal so that liquid ink is discharged, thereby stiffening when it has arrived at recording medium, either by using such ink that allows a part of heat energy to be utilized positively as the energy for the change of state from solid to liquid, to prevent the temperature up, or stiffens in the shelf state to avoid the evaporation of ink.

In this case, the ink can be held in recesses or through holes of a porous sheet as liquid or solid matter, and opposed to electricity-heat converters, as described in Japanese Laid-Open Patent Application No. 54-56847.

The most effective method for inks as above described in the present invention is one based on the film boiling as above indicated.

As clearly seen from the above description, according to the examples as previously described, there is provided an ink jet recording apparatus which records by discharging ink onto a recording medium, comprising a recording head, an ink storage tank, a supply side flow channel which can supply the ink from the storage tank to a common liquid chamber of recording head, a circulation side flow channel which can circulate the ink from the abovementioned common liquid chamber into the storage tank, a filter provided on the path of the supply side flow channel leading to the common liquid chamber, and back flow prevention means provided in the above-mentioned circulation side flow channel, wherein the ink fluid resistance between the common liquid chamber and the back flow prevention means is smaller than that of the filter, in order to prevent clogging of contaminants within the recording head, whereby the discharge ports can be further densified without necessity of a larger-sized recording head.

Further, according to the examples as previously described, there is provided an ink jet recording apparatus which records by discharging ink onto a recording medium, comprising a recording head having an ink liquid chamber for reserving ink and discharge ports for discharging the ink flowing in from the ink liquid chamber, ink circulating means for circulating the ink to the ink liquid chamber, and discharge port sealing means for sealing the discharge ports by tightly enclosing the discharge ports, which is used during operation of the ink circulating means, whereby the effect of removing contaminants in liquid channels within the recording head can be improved to accomplish the stable and reliable recording.

Further, according to the examples as previously described, there is provided a recovery method for performing the recovery operation for a recording head, wherein ink within the recording head is forced to move in one direction with a discharge port face being sealed by an enclosing member, whereby the effect of removing contaminants in liquid channels within the recording head can be improved to accomplish the stable and reliable recording.

As detailed above, according to the present invention, an ink jet recording apparatus and method for recovery of recording head which maintains the stable discharge condition of ink can be provided.

We claim:

1. An ink jet recording apparatus comprising:
   - an ink jet recording heat having discharge ports for discharging ink therethrough;
   - an ink storing portion for storing ink to be supplied to said recording heat;
   - a first flow path for communicating said recording head with said ink storing portion, said first flow path being provided with feeding means for feeding ink from said ink storing portion to said recording head, and not being provided with a valve;
   - a second flow path for communicating said recording head with said ink storing portion, said second flow path being provided with first back flow preventing means for preventing ink from flowing to said recording head; and
   - a third flow path for communicating said ink storing portion with an intermediate portion of said first flow path between said feeding means and said recording head, said third flow path being provided with second back flow preventing means for preventing ink from flowing to said ink storing portion.

2. An ink jet recording apparatus according to claim 1, wherein said recording head comprises electricity-heat converters for discharging ink through said discharge ports with heat energy.

3. An ink jet recording apparatus according to claim 1, wherein the ink is discharged through said discharge ports with a growth of bubbles due to the film boiling caused by heat energy from electricity-heat converters.

4. An ink jet recording apparatus according to claim 1, wherein an ink filter is provided in said first flow path and therefore ink flow resistance in said second flow path is smaller than that in said first flow path.

5. An ink jet recording apparatus according to claim 4, wherein said recording head discharges ink through said discharge ports with heat energy, and comprises electricity-heat converters for generating the heat energy.

6. An ink jet recording apparatus according to claim 5, wherein the ink is discharged through said discharge ports with a growth of bubbles due to film boiling caused by the heat energy applied by said electricity-heat converters.

7. An ink jet recording apparatus according to claim 1, further comprising head switch means movable between at least a closing position in which said discharge ports are closed and an opening position retracted from the closing position in which said discharge ports are opened, wherein said head switch means closes said discharge ports in the closing position for a longer time period than the time for allowing the discharge of ink through said discharge ports in the opening position, in a recovery operation.

8. An ink jet recording apparatus according to claim 1, further comprising head switch means, wherein said head switch means comprises a cap for covering said head and a pressing member for pressing said discharge ports, wherein said head switch means can take three positions of (1) a position where said cap covers said head and said pressing member presses said discharge ports, (2) a position where said cap covers said head while said pressing member is retracted to open said discharge ports, and (3) a position where said cap is retracted from the capping position and said pressing member is retracted to open said discharge ports.

9. An ink jet recording apparatus according to claim 8, wherein said recording head discharges ink through said discharge ports with heat energy, and comprises electricity-heat converters for generating the heat energy.

10. An ink jet recording apparatus according to claim 8, wherein said ink jet recording head discharges the ink through said discharge ports with a growth of bubbles due to film boiling caused by heat energy applied from electricity-heat converters.

11. An ink jet recording apparatus according to claim 1, further comprising ink circulating means for circulating the ink through said ink storing portion; discharge port sealing means for sealing said discharge ports by tightly closing said discharge ports, said sealing means being used during operation of said ink circulating means; and recovery means for exhausting the ink through said discharge ports, said recovery means being activated after a recovery operation by cooperation of said ink circulating means and said discharge port sealing means, wherein said recovery means includes a pressure mechanism using said feeding means.

12. An ink jet recording apparatus according to claim 11, wherein said recording head discharges ink with heat energy, and comprises electricity-heat converters for generating the heat energy.

13. An ink jet recording apparatus according to claim 11, wherein said ink jet recording head discharges the ink through said discharge ports with a growth of bubbles due to film boiling caused by the heat energy applied from said electricity-heat converters.

14. An ink jet recording apparatus according to claim 1, further comprising a recovery means operable in a recovery operation, wherein the recovery operation is characterized in that the ink within said recording head is forced to move in one direction with said discharge ports being sealed by a sealing means.

15. An ink jet recording apparatus according to claim 14, wherein said recording head discharges ink through said discharge ports with heat energy, and comprises electricity-heat converters for generating the heat energy.

16. An ink jet recording apparatus according to claim 14, wherein said ink jet recording heat discharges the ink through said discharge ports with a growth of bubbles due to film boiling caused by heat energy applied from electricity-heat converters.

17. An ink jet recording apparatus according to claim 1, further comprising a recovery means operable in a recovery operation for said recording head, the recovery operation including a first recovery stroke in which the ink within said recording head is forced to move in one direction with said discharge ports being sealed by a sealing means, and a second recovery stroke in which said discharge ports are opened and the ink is discharged through said discharge ports from within the recording head.

18. An ink jet recording apparatus according to claim 17, wherein said recording head discharges ink through said discharge ports with heat energy, and comprises electricity-heat converters for generating the heat energy.

19. An ink jet recording apparatus according to claim 18, wherein said ink jet recording head discharges the ink through said discharge ports with a growth of bubbles due to film boiling caused by the heat energy applied from said electricity-heat converters.

20. An ink jet recording apparatus according to claim 17, wherein said recovery means comprises a pressure recovery mechanism having said feeding means.

21. An ink jet recording apparatus according to claim 18, wherein said recovery means comprises a pressure recovery mechanism having said feeding means.

22. An ink jet recording apparatus according to claim 19, wherein said recovery means comprises a pressure recovery mechanism having said feeding means.

23. An ink jet recording apparatus comprising:

an ink jet recording heat having discharge ports for discharging ink therethrough;

an ink storing portion for storing ink to be supplied to said recording head;

a first flow path for communicating said recording head with said ink storing portion, said first flow path being provided with feeding means for feeding ink from said ink storing portion to said recording head, and not being provided with a valve;

a second flow path for communicating said recording head with said ink storing portion, said second flow path being provided with first straightening valve for preventing ink from flowing to said recording head; and a third flow path for communicating said ink storing portion with an intermediate portion of said first flow path between said feeding means and said recording head, said third flow path being provided with a second straightening valve for preventing ink from flowing to said ink storing portion.

* * * * *

UNITED STATES PATENT AND TRADEMARK OFFICE

CERTIFICATE OF CORRECTION

PATENT NO. : 5,231,424

DATED : July 27, 1993

INVENTOR(S) : MINEO KANEKO, ET AL.

It is certified that error appears in the above-identified patent and that said Letters Patent is hereby corrected as shown below:

COLUMN 2

Line 37, "entagled" should read --entangled--.
Line 45, "more finely" should read --finer--.
Line 50, "more largely." should read --larger.--.

COLUMN 3

Line 66, "20." should read --120.--.

COLUMN 7

Line 44, "2" should read --32--.
Line 46, "in," should read --in--.

COLUMN 8

Line 22, "3" should read --33--.

COLUMN 10

Line 17, "does" should read --do--.
Line 63, "54" should read --64--.

COLUMN 11

Line 33, "On" should read --on--.
Line 55, "7" should read --57--.

COLUMN 12

Line 22, "generation" should read --operation--.
Line 60, "are" should read --is--.

UNITED STATES PATENT AND TRADEMARK OFFICE

CERTIFICATE OF CORRECTION

PATENT NO. : 5,231,424

DATED : July 27, 1993

INVENTOR(S) : MINEO KANEKO, ET AL.

It is certified that error appears in the above-identified patent and that said Letters Patent is hereby corrected as shown below:

COLUMN 13

Line 41, "SO" should read --so--.

COLUMN 14

Line 26, "1" should read --1001-- and
"5," should read --54,--.
Line 32, "whole" should read --all--.
Line 53, "matters" should read --matter--.

COLUMN 15

Line 21, "sate," should read --state,--.
Line 24, "5" should read --54--.
Line 46, "quoted." should read --omitted.--.
Line 56, "head" should read --the head--.

COLUMN 16

Line 9, "preferred" should read --preferred.--.
Line 43, "use" should read --use of--.

COLUMN 17

Line 20, "One" should read --one--.

COLUMN 18

Line 30, "heat" should read --head--.
Line 33, "heat;" should read --head;--.

--

UNITED STATES PATENT AND TRADEMARK OFFICE

CERTIFICATE OF CORRECTION

PATENT NO. : 5,231,424

DATED : July 27, 1993

INVENTOR(S) : MINEO KANEKO, ET AL.

It is certified that error appears in the above-identified patent and that said Letters Patent is hereby corrected as shown below:

COLUMN 20

Line 43, "heat" should read --head--.

Signed and Sealed this

Fifth Day of April, 1994

Bruce Lehman

BRUCE LEHMAN

*Commissioner of Patents and Trademarks*

*Attest:*

*Attesting Officer*

--